US011603690B2

(12) United States Patent
Pierce

(10) Patent No.: US 11,603,690 B2
(45) Date of Patent: Mar. 14, 2023

(54) LOCATING SYSTEM FOR AN EXTERNAL DOOR HINGE

(71) Applicant: Haier US Appliance Solutions, Inc., Wilmington, DE (US)

(72) Inventor: Andrew Pierce, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 2 days.

(21) Appl. No.: 17/237,454

(22) Filed: Apr. 22, 2021

(65) Prior Publication Data

US 2022/0341232 A1 Oct. 27, 2022

(51) Int. Cl.
*E05D 7/081* (2006.01)
*F25D 23/02* (2006.01)

(52) U.S. Cl.
CPC ..... *E05D 7/081* (2013.01); *F25D 23/028* (2013.01); *E05Y 2600/56* (2013.01); *E05Y 2900/31* (2013.01); *F25D 2323/024* (2013.01)

(58) Field of Classification Search
CPC ..... E05Y 2900/31; E05Y 2600/56; E05Y 2600/622; E05Y 2600/63; E05D 7/081; F25D 2323/02; F25D 23/028; F25D 2323/024; Y10T 16/52; Y10T 16/535
See application file for complete search history.

(56) References Cited

U.S. PATENT DOCUMENTS 2,990,570 A * 7/1961 Gilpatrick ..... E05D 7/12 16/257
3,675,271 A * 7/1972 Fellwock ..... E05D 7/081 16/265
4,785,497 A * 11/1988 Salice ..... E05D 5/0276 16/370
4,932,729 A * 6/1990 Thompson ..... A47B 91/002 16/19
5,150,500 A * 9/1992 Bisbing ..... E05D 5/0215 16/239
5,232,277 A * 8/1993 Cassady ..... E05D 5/065 16/221
5,666,764 A * 9/1997 Beatty ..... F25D 23/028 16/254

(Continued)

FOREIGN PATENT DOCUMENTS

CN 205243235 U 5/2016
CN 205400355 U 7/2016

OTHER PUBLICATIONS

English translation of CN205243235 (Year: 2016).*

*Primary Examiner* — Hiwot E Tefera
(74) *Attorney, Agent, or Firm* — Dority & Manning, P.A.

(57) ABSTRACT

A hinge structure includes a cabinet plate defining a first face and a second face, the cabinet plate including a first fastening hole, a stiffener plate in planar contact with the first face of the cabinet plate along the Z-axis, the stiffener plate including a second fastening hole, a hinge plate in planar contact with the second face of the cabinet plate along the Z-axis, the hinge plate including a locating hole, and a fastener for fastening the cabinet plate to the stiffener plate, the fastener protruding through the first fastening hole and the second fastening hole along the Z-axis and including a fastener head, wherein the fastener head is cylindrical and accepted within the locating hole of the hinge plate.

17 Claims, 4 Drawing Sheets

(56) References Cited

U.S. PATENT DOCUMENTS

| | | | | |
|---|---|---|---|---|
| 5,752,291 | A * | 5/1998 | Snyder | E05D 7/04 16/235 |
| 5,788,351 | A * | 8/1998 | Prunty | F24C 15/023 16/DIG. 34 |
| 5,992,028 | A * | 11/1999 | Wing | E05D 7/081 33/194 |
| 6,286,262 | B1 * | 9/2001 | Prevot | E05D 15/5205 16/384 |
| 8,491,070 | B2 | 7/2013 | Gabriel | |
| 9,897,136 | B1 * | 2/2018 | Wu | E05D 3/02 |
| 2004/0025295 | A1 * | 2/2004 | Becker | F16C 11/04 16/254 |
| 2010/0026155 | A1 * | 2/2010 | Yun | E05D 7/081 312/405 |
| 2010/0033067 | A1 * | 2/2010 | Kim | F25D 23/028 312/236 |
| 2017/0159993 | A1 * | 6/2017 | Giacomini | F25D 23/028 |

* cited by examiner

LOCATING SYSTEM FOR AN EXTERNAL DOOR HINGE

FIELD OF THE INVENTION

The present subject matter relates generally to hinges, and more particularly to locating systems for externally mounted door hinges.

BACKGROUND OF THE INVENTION

Some conventional home appliances, such as refrigerator appliances, include cabinets for storing items and a door or doors rotatably attached to the cabinets to provide selective access to the cabinet. Such doors are typically attached to the cabinet by way of a hinge that allows the door to rotate with respect to the cabinet. Such hinges may be mounted externally, e.g., on a top, bottom, or side of the cabinet as opposed to an interior of the cabinet. As such, multiple components are required to be aligned correctly in order for the hinge or hinges to operate properly. Accordingly, assemblers require precision in aligning multiple components including the hinge or hinges before assembling the hinge or hinges to the cabinet and door.

However, current hinges exhibit a number of drawbacks. For instance, multiple fasteners may be required to attach the hinge to the cabinet. This may lead to the hinge being located improperly, which in turn decreases an operation smoothness of the door and increases fatigue in one or more of the hinge, the door, and the cabinet. As another example, additional locating features may be required to properly locate and position the hinge. This increases material costs, including machining additional holes in the hinge and cabinet and/or necessitates additional assembly steps. Thus, further improvements are necessary to produce a more effective hinge locating system.

Accordingly, a hinge that obviates one or more of the above-mentioned drawbacks would be useful. In particular, a hinge including an efficient locating system that results in precise assembly would be especially beneficial.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a hinge assembly is provided. The hinge assembly hinge structure may define an X-axis, a Y-axis, and a Z-axis. The hinge assembly may include a cabinet plate defining a first face and a second face, the cabinet plate comprising a first locating hole; a stiffener plate in contact with the first face of the cabinet plate along the Z-axis, the stiffener plate comprising a second locating hole; a fastener for fastening the cabinet plate to the stiffener plate, the fastener protruding through the first locating hole and the second locating hole along the Z-axis and comprising a fastener head; and a hinge plate in contact with the second face of the cabinet plate along the Z-axis, the hinge plate comprising a third locating hole, wherein the fastener head is accepted within the third locating hole of the hinge plate.

In another exemplary aspect of the present disclosure, a method of assembling a hinge structure is provided. The hinge structure may define an X-axis, a Y-axis, and a Z-axis, and may include a hinge plate, a cabinet plate defining a first face and a second face, a stiffener plate, and a rivet comprising a cylindrical head. The method may include attaching the cabinet plate to the stiffener plate via the rivet such that the stiffener plate is in contact with the first face of the cabinet plate and the cylindrical head is in contact with the second face of the cabinet plate; inserting the cylindrical head of the rivet through a locating hole defined in the hinge plate; and fastening the hinge plate to the cabinet plate and the stiffener plate via a fastener.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
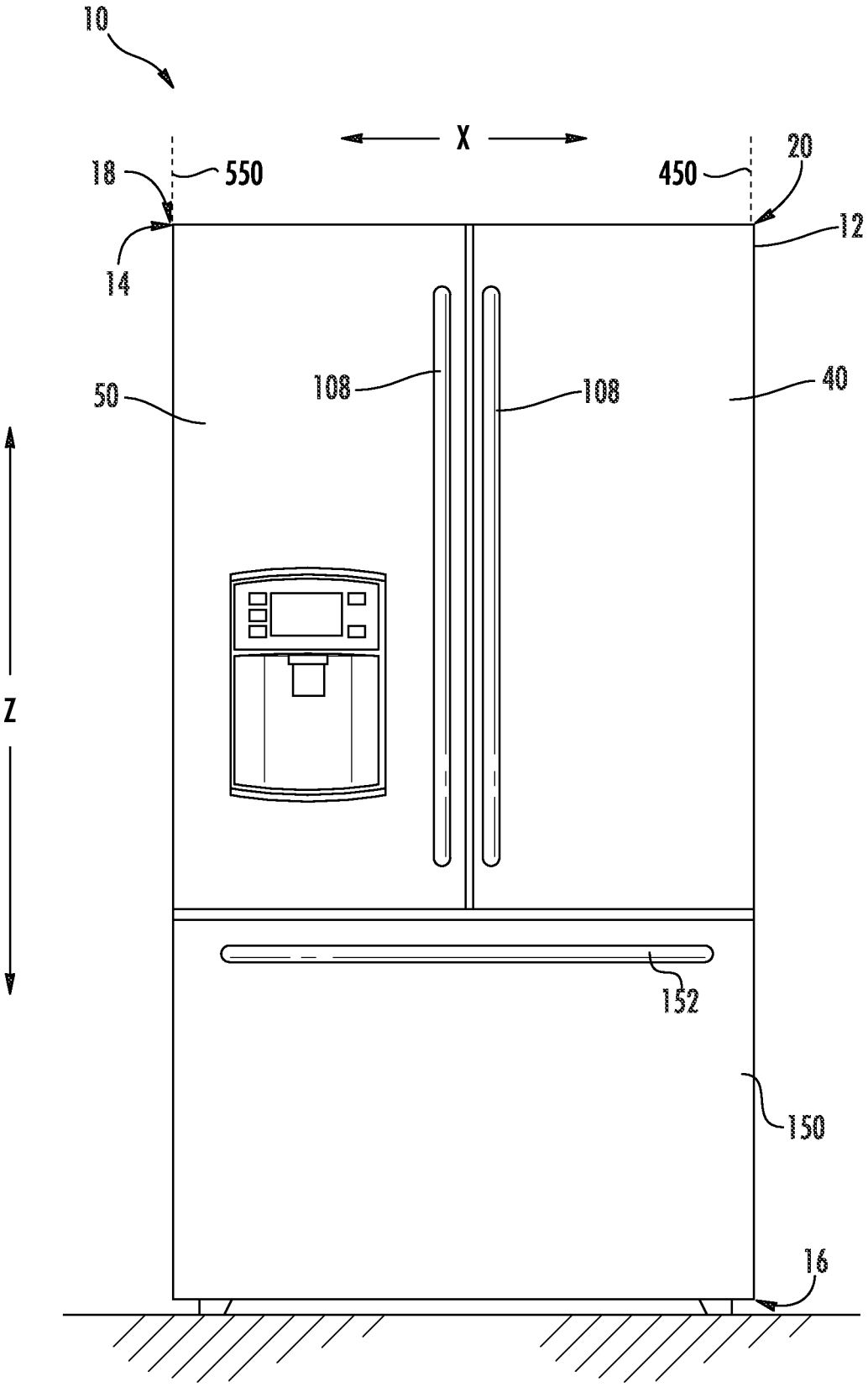
FIG. 1 provides a front elevation view of a refrigerator appliance according to exemplary embodiments of the present disclosure.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component or position from another and are not intended to signify an absolute location or importance of the individual components. Terms such as "inner" and "outer" refer to relative directions with respect to the interior and exterior of the refrigerator appliance, and in particular the food storage chamber(s) defined therein. For example, "inner" or "inward" refers to the direction towards the interior of the refrigerator appliance. Terms such as "left," "right," "front," "back," "top," or "bottom" are used with reference to the perspective of a user accessing the refrigerator appliance. For example, a user stands in front of the refrigerator to open the doors and reaches into the food storage chamber(s) to access items therein.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components and/or systems. For example, the approximating language may refer to being within a 10 percent margin, i.e., including values within ten percent greater or less than the stated value. In this regard, for example, when used in the context of an angle or direction, such terms include within ten degrees greater or less than the stated angle or direction, e.g., "generally vertical" includes forming an angle of up to ten degrees in any direction, e.g., clockwise or counterclockwise, with the vertical direction V.

Referring now to FIG. 1, a refrigerator appliance 10 according to an embodiment of the present subject matter defines an X-axis, a Y-axis, and a Z-axis, each mutually perpendicular to one another. In some embodiments, the directions may be referred to as a vertical direction V, a lateral direction L, and a transverse direction T. For instance, the X-axis may correspond with the lateral direction L, the Y-axis may correspond with the transverse direction T, and the Z-axis may correspond with the vertical direction V. As may be seen, the refrigerator appliance 10 includes a housing or cabinet 12 that extends between a top 14 and a bottom 16 along the Z-axis, between a left side 18 and a right side 20 along the X-axis, and between a front side 22 and a rear side 24 along the Y-axis (see, e.g., FIG. 2).

The cabinet 12 may generally define a food storage chamber for receipt of food items for storage. In particular, the food storage chamber is positioned at or adjacent the top 14 of the cabinet 12. It should be appreciated, however, that the food storage chamber may be positioned at any suitable location within the refrigerator appliance 10. For example, in one embodiment, the food storage chamber may extend from top 14 to bottom 16 along the vertical direction V.

The refrigerator appliance 10 may include one or more refrigerator doors 40, 50 rotatably mounted to the cabinet, e.g., such that the refrigerator doors 40, 50 permit selective access to the food storage chamber 100. As shown, in some embodiments, the refrigerator doors 40, 50 include a right refrigerator door (e.g., first side door) 40 and a left refrigerator door (e.g., second side door) 50. The right refrigerator door 40 may be rotatably mounted to the cabinet 12 at the right side 20 of the cabinet 12. The left refrigerator door 50 may be rotatably mounted to the left side 18 of the cabinet 12. The right refrigerator door 40 may pivot about a first pivot axis 450. The left refrigerator door 50 may pivot about a second pivot axis 550. A handle 108 may be positioned on each of the refrigerator doors 40, 50 to facilitate movement of the doors 40, 50 between a fully closed position (FIG. 1) and a fully open position (not shown).

Additionally or alternatively, the refrigerator appliance 10 may include a freezer drawer 150 arranged below the refrigerator doors 40, 50 for selectively accessing items within a frozen food storage chamber (not shown). The freezer drawer 150 may include a handle 152 that is slidably mounted to the cabinet 12. Accordingly, the freezer drawer 150 may be moved in and out of the frozen food storage chamber along the transverse direction T.

Figure 2:
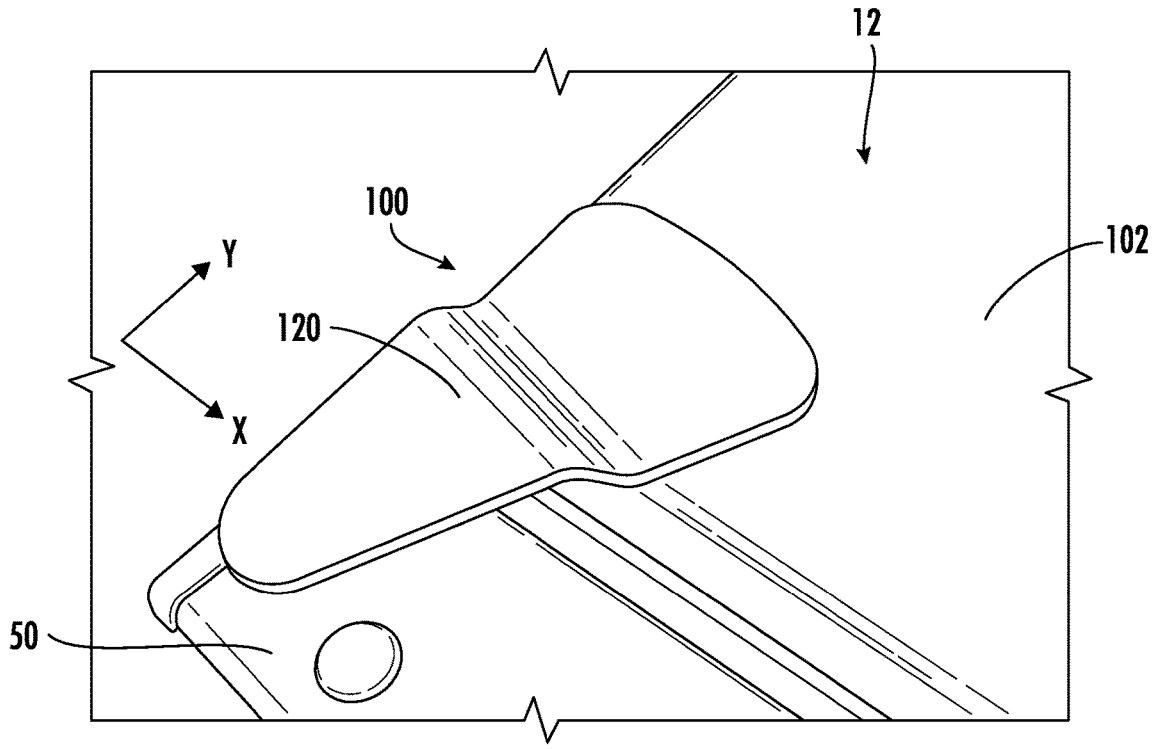
FIG. 2 provides a perspective view of a hinge structure of the exemplary refrigerator appliance of FIG. 1.

FIG. 2 provides a top perspective view of an exemplary refrigerator appliance 10. Particularly, FIG. 2 shows part of an exemplary hinge assembly or structure 100 connecting left refrigerator door 50 to cabinet 12. For instance, hinge assembly 100 may include a hinge plate 120 connecting left refrigerator door 50 (or right refrigerator door 40) to cabinet 12. Cabinet 12 may include a cabinet plate 102. In some embodiments, cabinet plate 102 is a top plate of cabinet 12. It should be understood that cabinet plate 102 may be any suitable plate of cabinet 12 to which hinge plate 120 may be attached to allow a door (e.g., left refrigerator door 50 or right refrigerator door 40) to rotate with respect to cabinet 12. For instance, refrigerator appliance 10 may be a chest-style refrigerator or freezer appliance. In this case, cabinet plate 102 may be a side plate of cabinet 12. Accordingly, the illustrated embodiment is merely an example, and the applied coordinate system may be adjusted according to specific embodiments. Moreover, FIG. 2 merely provides an example of a hinge assembly 100, and additional elements (e.g., fasteners, etc.) are shown in subsequent figures.

Figure 6:
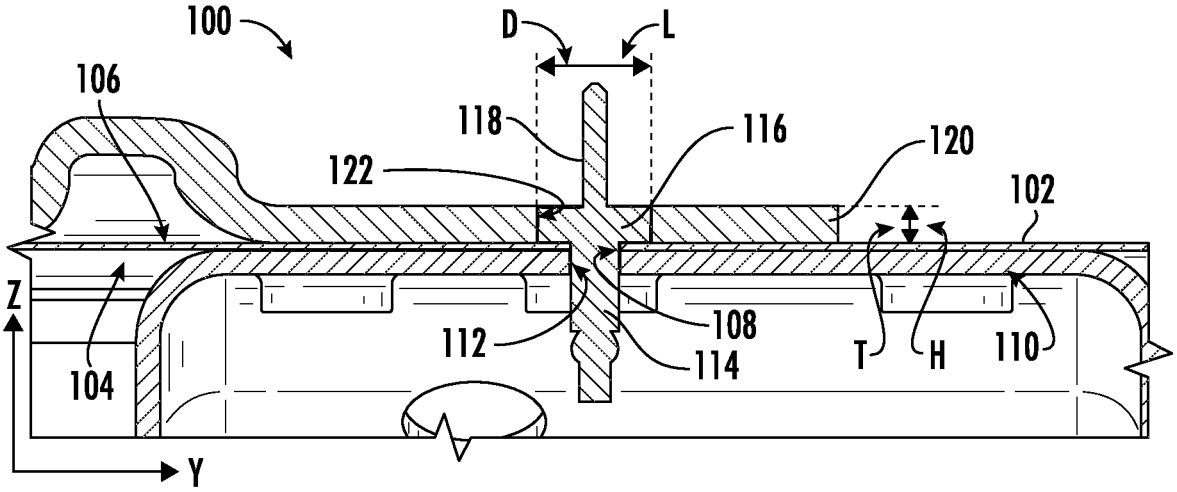
FIG. 6 provides a cross-section view of the exemplary hinge structure of FIG. 4 taken along section A-A as shown in FIG. 5.

Cabinet plate 102 may include a first face 104 and a second face 106 opposite first face 104 (see, e.g., FIG. 6). First face 104 may be an interior face of cabinet plate 102 (e.g., not externally visible to a user), while second face 106 may be an exterior face of cabinet plate 102 (e.g., visible to the user). Cabinet plate 102 may include a locating hole 108 (FIG. 6). Locating hole 108 may be referred to as a first locating hole 108. First locating hole 108 may assist in locating and aligning cabinet plate 102 with a stiffener plate 110 (described below). For instance, first locating hole 108 may accept a fastener 114 (described below) therethrough to attach cabinet plate 102 with stiffener plate 110. First locating hole 108 may be a through-hole formed through cabinet plate 102 (e.g., from first face 104 to second face 106). First locating hole may have a predetermined diameter suitable for accepting a fastener therethrough (e.g., a screw, a pin, a bolt, a rivet, etc.).

Figure 3:
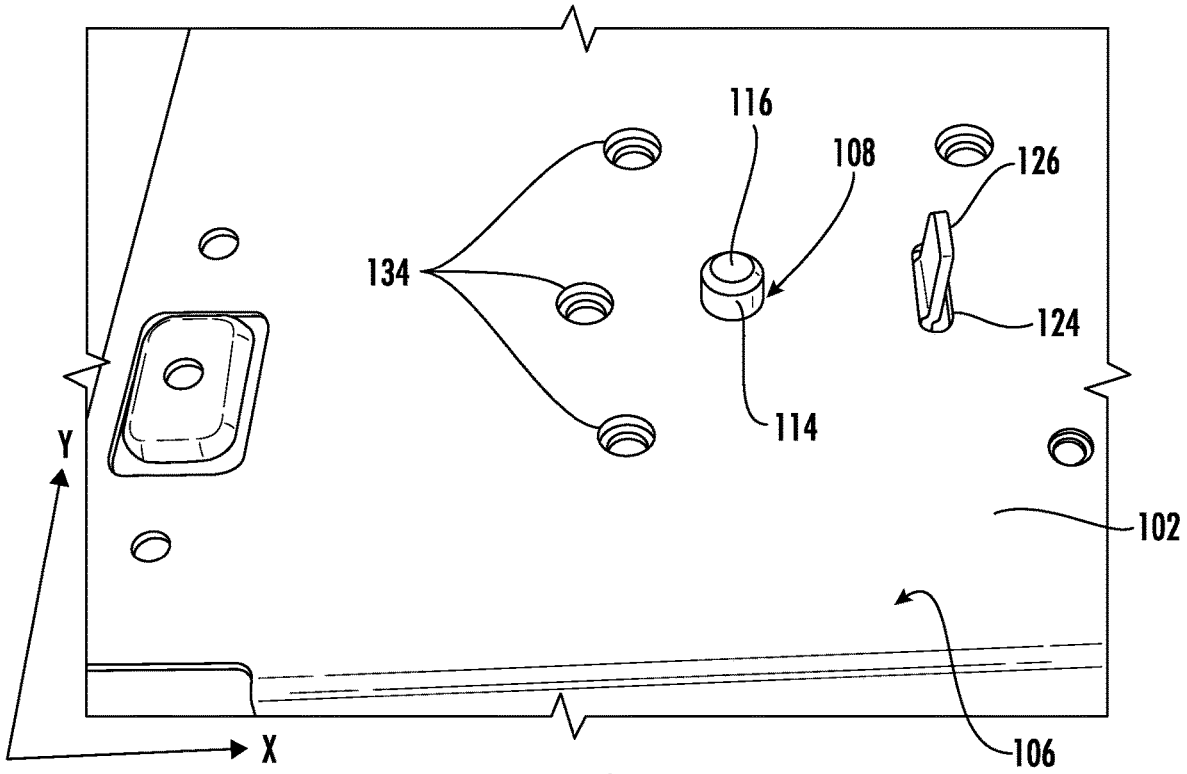
FIG. 3 provides a perspective view of a top of a cabinet of the exemplary refrigerator appliance of FIG. 1 with the hinge plate removed.
Figure 4:
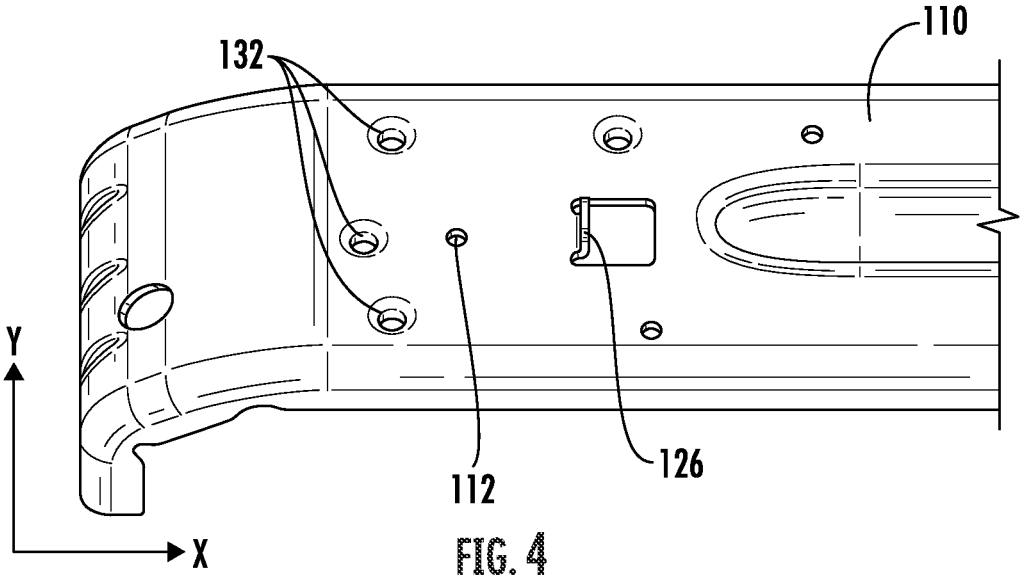
FIG. 4 provides a perspective view of a stiffener plate of the exemplary refrigerator appliance of FIG. 1.

Referring primarily to FIG. 3, cabinet plate 102 may further include a plurality of fastening holes 134. In some embodiments, cabinet plate 102 includes three fastening holes 134 (e.g., as shown in FIG. 4). Any suitable number of fastening holes 134 may be formed in cabinet plate 102. Fastening holes 134 may be arranged in any suitable fashion such that additional fasteners (e.g., bolts, screws, etc.) may penetrate cabinet plate 102 to fasten cabinet plate 102 with stiffener plate 110 and hinge plate 120. Fastening holes 134 may have predetermined diameters suitable for accepting fasteners therethrough. In some embodiments, the diameters of fastening holes 134 are larger than the diameter of first locating hole 108. Fastening holes 134 may be spaced apart from first locating hole 108.

Cabinet plate 102 may further include a protrusion slot 124. Protrusion slot 124 may be provided adjacent to first locating hole 108 (e.g., along the X-axis). Protrusion slot 124 may be defined along the Z-axis. For instance, protrusion slot 124 may de defined from first face 104 to second face 106 of cabinet plate 102. Protrusion slot 124 may be formed as a slot having a length along the Y-axis greater than a width along the X-axis (e.g., as seen in FIG. 4). However, this design is merely exemplary, and protrusion slot 124 may have any suitable shape. Protrusion slot 124 may be spaced apart from first locating hole 108 by a predetermined distance. For instance, protrusion slot 124 may be spaced apart from first locating hole by about 1 inch to about 3 inches.

FIG. 4 provides a perspective view of a stiffener plate according to exemplary embodiments of the present disclosure. For instance, hinge assembly 100 may include a stiffener plate 110. Stiffener plate 110 may be located on an underside of cabinet plate 102. In detail, stiffener plate 110 may be in contact with first face 104 of cabinet plate 102. For instance, stiffener plate 110 may be in planar contact with first face 104 of cabinet plate 102. Stiffener plate 110 may extend along the X-axis direction, for example, from left side 18 of cabinet 12 to right side 20 of cabinet 12. However, this is provided merely as an example, and an orientation of stiffener plate 110 may be altered according to specific embodiments and applications.

Stiffener plate 110 may include a stiffener protrusion 126. Stiffener protrusion 126 may extend along the Z-axis from stiffener plate 110 (e.g., toward cabinet plate 102). For example, stiffener protrusion 126 may extend at a right angle with respect to stiffener plate 110. Stiffener protrusion 126 may be formed as a tab (e.g., as shown in FIGS. 3 and 4). In some embodiments, stiffener protrusion 126 may be bent along the Y-axis from stiffener plate 110. Accordingly, stiffener protrusion 126 may be integrally formed with stiffener plate 110. Stiffener protrusion 126 may be formed so as to protrude through protrusion slot 124 of cabinet plate 102 (e.g., as shown in FIG. 3). Advantageously, stiffener protrusion 126 may assist in locating stiffener plate 110 with respect to cabinet plate 102 without requiring additional pieces, thus improving manufacturing precision and reducing manufacturing time and material.

Stiffener plate 110 may include a locating hole 112. Locating hole 112 may be referred to as a second locating hole 112. Second locating hole 112 may be defined along the Z-axis (i.e., an axis of second locating hole 112 may be defined along the Z-axis). Second locating hole 112 may assist in locating and aligning stiffener plate 110 with cabinet plate 102 (e.g., by way of a fastener 114 described below). For instance, second locating hole 112 may be aligned with first locating hole 108 (e.g., along the Z-axis). In detail, after stiffener protrusion 126 is inserted through protrusion slot 124, second locating hole 112 may be axially aligned with first locating hole 108 (e.g., along the Z-axis).

Stiffener plate 110 may include a plurality of fastening holes 132. For instance, the plurality of fastening holes 132 of the stiffener plate 110 may correspond with the plurality of fastening holes 134 of cabinet plate 102. Accordingly, as shown in FIG. 4, the plurality of fastening holes 132 may be three fastening holes 132. Any suitable number of fastening holes 132 may be formed in stiffener plate 110. Fastening holes 132 may be arranged in any suitable fashion such that additional fasteners (e.g., bolts, screws, etc.) may penetrate stiffener plate 102 and cabinet plate 102 to fasten cabinet plate 102 with stiffener plate 110 and hinge plate 120. Fastening holes 132 may have predetermined diameters suitable for accepting fasteners therethrough. In some embodiments, the diameters of fastening holes 132 are larger than the diameter of second locating hole 112 (e.g., as shown in FIG. 4). Fastening holes 132 may be spaced apart from second locating hole 112.

Figure 5:
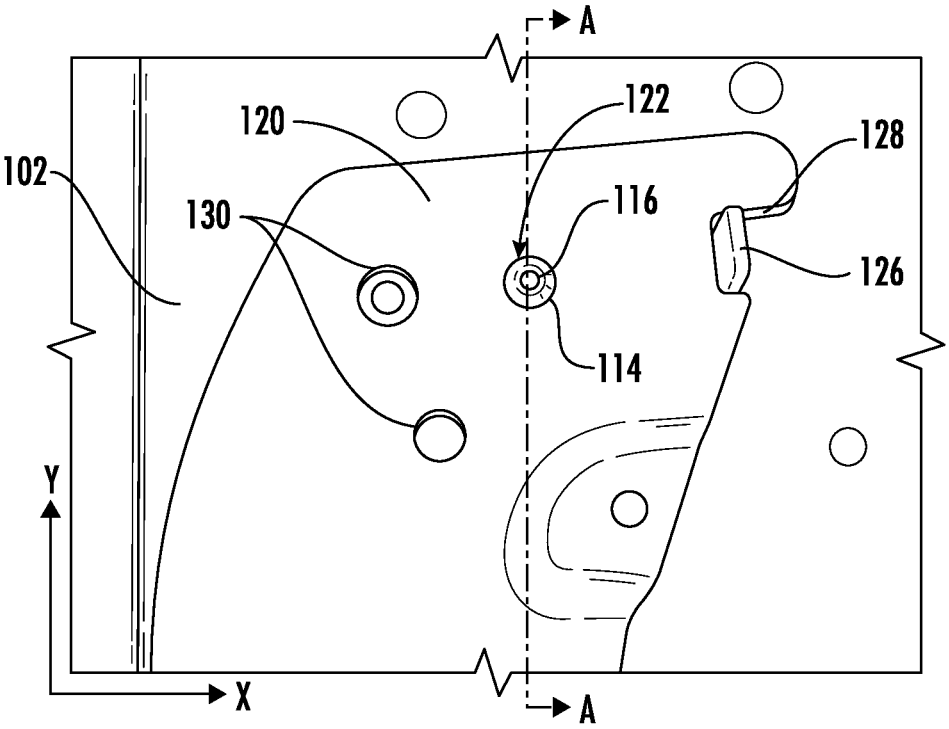
FIG. 5 provides a top view of an exemplary hinge structure according to embodiments of the present disclosure.

Referring to FIGS. 3, 5, and 6, hinge assembly 100 may include a fastener 114 for fastening cabinet plate 102 to stiffener plate 110. In some embodiments, fastener 114 is a rivet. However, it should be understood that any suitable fastener may be used to join cabinet plate 102 to stiffener plate 110. Fastener 114 may be inserted through first locating hole 108 of cabinet plate 102 and second locating hole 112 of stiffener plate 110. Fastener 114 may include a fastener head 116 and a fastener mandrel 118 (e.g., a rivet heat and a rivet mandrel). Fastener head 116 may be cylindrical. However, fastener head 114 may have any suitable cross-sectional shape (e.g., in an X-Y plane). Fastener head 116 may protrude from second face 106 of cabinet plate 102 (e.g., on an exterior surface of cabinet plate 102) when fastener 114 is in an inserted position. In detail, fastener head 116 may have a predetermined thickness T along the Z-axis. The predetermined thickness T may be between about ¼" and about ½". Thus, the fastener head 116 may form a locating nub on second face 106 of cabinet plate 102. Additionally, fastener head 116 may have a predetermined diameter D (e.g., in the X-Y plane). For instance, the predetermined diameter D may be between about ¾" and about ½". Advantageously, a single fastener (e.g., fastener 114) may be used to couple cabinet plate 102 to stiffener plate 110 and provide a locating nub (e.g., fastener head 116) for locating hinge plate 120 during assembly.

Hinge assembly 110 may further include hinge plate 120. Hinge plate 120 may rotatably connect cabinet 12 (e.g., cabinet plate 102) with a rotating door (e.g., right refrigerator door 40 or left refrigerator door 50). Hinge plate 120 may be in contact with second face 106 of cabinet plate 102. For instance, hinge plate 120 may be in planar contact with second face 106 of cabinet plate 102. Hinge plate 120 may have any suitable peripheral shape (i.e., any shape defining an outer edge of hinge plate 120).

Hinge plate 120 may include a locating hole 122. Locating hole 122 may be referred to as a third locating hole 122. Third locating hole 122 may correspond to first locating hole 108 and second locating hole 112. In detail, third locating hole 122 may be coaxial with first locating hole 108 and second locating hole 112 (e.g., when hinge plate is in an assembled position). Third locating hole 122 may be a through hole having a predetermined diameter L. In detail, the diameter L of third locating hole 122 may correspond to diameter D of fastener head 116. For instance, diameter L of third locating hole 122 may be substantially the same as diameter D of fastener head 116. For purposes of this disclosure, "substantially" or "predominantly" refers to a tolerance of 5%. Accordingly, diameter D of fastener head 116 may be within 5% of diameter L of third locating hole 122. Advantageously, a precise location of hinge plate 120 with respect to cabinet plate 102 may be ensured.

Hinge plate 120 may have a predetermined thickness H (e.g., along the Z-axis). Thickness H of hinge plate 120 may be substantially equal to thickness T of fastener head 116. Thus, when third locating hole 122 of hinge plate 120 is fit over fastener head 116, a top of fastener head 116 may be substantially flush with a top surface of hinge plate 120 (e.g., as seen in FIG. 6). Additionally or alternatively, thickness T of fastener head 116 may be greater than thickness H of hinge plate 120. For example, fastener head 116 may protrude a predetermined amount above hinge plate 120 along the Z-axis when hinge plate 120 is fit over fastener head 116. Hinge plate 120 may include a plurality of fastening holes 130 defined along the Z-axis. Each of the fastening holes 130 may have identical diameters. In detail, each of the fastening holes 130 may be sized identically. The plurality of fastening holes 130 may correspond to the plurality of fastening holes 134 in cabinet plate 102 and the plurality of fastening holes 132 in stiffening plate 110. However, it should be understood that hinge plate 120 may contain more or fewer fastening holes 130 according to specific embodiments (e.g., to accommodate multiple assembly positions with respect to cabinet plate 102).

Hinge plate 120 may further include a notch 128. Notch 128 may receive stiffener protrusion 126 therein (e.g., when hinge plate 120 is assembled to cabinet plate 102 over fastener head 116). In some embodiments, notch 128 is provided proximate the periphery (e.g., outer edge) of hinge plate 120. For instance, notch 128 may be formed as a cut-out portion of hinge plate 120 (e.g., as seen in FIG. 5). As such, notch 128 may partially surround stiffener protrusion 126 (e.g., along the X-axis and the Y-axis). Accordingly, when third locating hole 122 is fit over fastener head 116, stiffener protrusion 126 may be received within notch 128. Advantageously, fastener head 116 may prevent translation of hinge plate 120 with respect to cabinet plate 120 along the X-axis and the Y-axis while stiffener protrusion 126 may prevent a rotation of stiffener plate 120 about fastener head 116. Thus, proper and precise location and assembly of hinge plate 120 may be executed using a single fastener and an integral protrusion, reducing assembly time, assembly material, and risk of misplacement.

Figure 7:
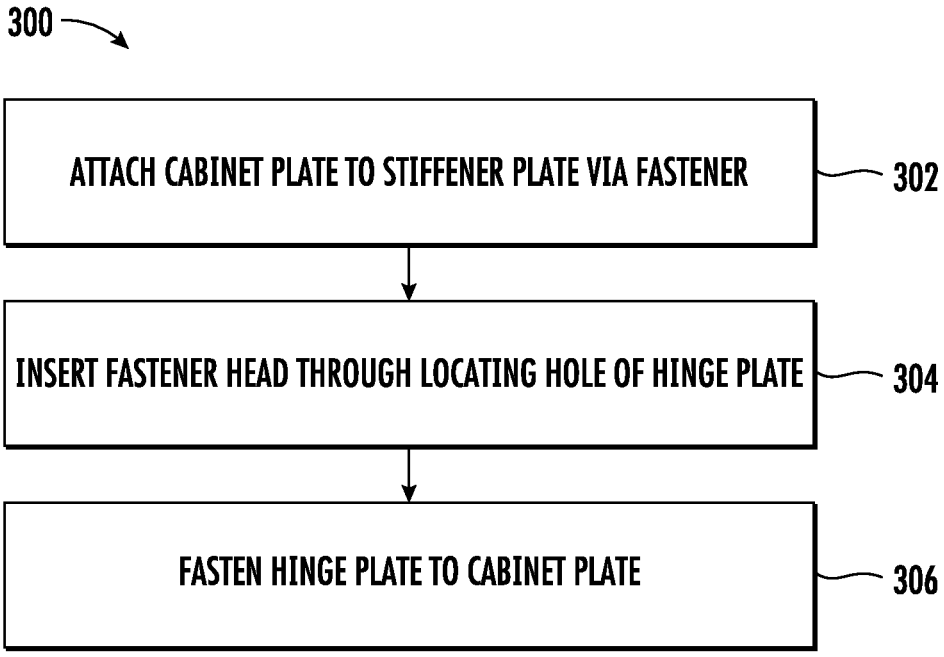
FIG. 7 provides a flow chart illustrating a method of assembling an exemplary hinge structure according to the present disclosure.

FIG. 7 provides a flow chart illustrating a method of assembling a hinge structure (e.g., hinge assembly 100). It should be understood that the following method may be applied to any suitable hinge structure. Additionally or alternatively, although a refrigerator appliance is used as an example, any suitable appliance may incorporate the disclosed hinge structure and assembly. At step 302, method 300 may include attaching a cabinet plate (e.g., cabinet plate 102) to a stiffener plate (e.g., stiffener plate 110) via a fastener (e.g., fastener 114). The cabinet plate may be an external plate corresponding to the appliance (e.g., refrigerator appliance 10). The stiffener plate may be a structurally rigid member provided on an interior face of the cabinet plate to provide support to the cabinet plate. Using hinge assembly 100 as an example, the fastener (e.g., a rivet) may be inserted through a first locating hole on the cabinet plate (e.g., first locating hole 108) and a second locating hole on the stiffener plate (e.g., second locating hole 112). A fastener head (e.g., fastener head 116) may remain protruding from an outer face of the cabinet plate after assembly.

At step 304, method 300 may include inserting the fastener head through a third locating hole (e.g., third locating hole 122) of a hinge plate (e.g., hinge plate 120). The hinge plate may be pressed onto fastener head such that the hinge plate contacts the outer face of the cabinet plate. In some embodiments, a diameter of the fastener head is substantially equal to a diameter of the third locating hole (e.g., within 5%). Additionally or alternatively, a thickness of the fastener head (e.g., from the outer face of the cabinet plate) may be substantially equal to a thickness of the hinge plate. Accordingly, a top of the fastener head may be flush with an outer face of the hinge plate.

At step 306, method 300 may include fastening the hinge plate to the cabinet plate and the stiffener plate. For example, additional fasteners may be inserted through fastening holes (e.g., fastening holes 130, 132, 134) so as to attach the hinge plate to the cabinet plate and the stiffener plate. The additional fasteners may be any suitable fasteners, such as bolts, screws, rivets, tacks, or the like. Any suitable number of fasteners may be used to ensure rigid connection of the hinge plate to the cabinet plate and the stiffener plate. In some embodiments, the stiffener plate may include a stiffener protrusion (e.g., stiffener protrusion 126). The stiffener protrusion may protrude through the cabinet plate and engage with a notch (e.g., notch 128) on the hinge plate. Accordingly, the hinge plate may be restricted from translating or rotating with respect to the cabinet plate and the stiffener plate.

The word "exemplary" is used herein to mean "serving as an example, instance, or illustration." In addition, references to "an embodiment" or "one embodiment" does not necessarily refer to the same embodiment, although it may. Any implementation described herein as "exemplary" or "an embodiment" is not necessarily to be construed as preferred or advantageous over other implementations. Moreover, each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents. The terms "coupled," "fixed," "attached to," and the like refer to both direct coupling, fixing, or attaching, as well as indirect coupling, fixing, or attaching through one or more intermediate components or features, unless otherwise specified herein.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A hinge assembly defining an X-axis, a Y-axis, and a Z-axis, the hinge assembly comprising:

a cabinet plate defining a first face and a second face, the cabinet plate comprising a first locating hole, the cabinet plate forming at least a portion of a cabinet defining an interior volume;

a stiffener plate in contact with the first face of the cabinet plate along the Z-axis, the stiffener plate comprising a second locating hole, and a stiffener protrusion spaced apart from the second locating hole and protruding along the Z-axis;

a fastener for fastening the cabinet plate to the stiffener plate, the fastener protruding through the first locating hole and the second locating hole along the Z-axis and comprising a fastener head, wherein the fastener is a rivet and the fastener head is a cylindrical rivet head; and a hinge plate in contact with the second face of the cabinet plate along the Z-axis, the hinge plate comprising a third locating hole, wherein the fastener head is accepted within the third locating hole of the hinge plate after the stiffener plate is attached to the cabinet via the fastener, wherein a diameter of the third locating hole is predominantly equal to a diameter of the cylindrical rivet head, and wherein the hinge plate further comprises a notch cut into a lateral edge of the hinge plate for receiving the stiffener protrusion.

2. The hinge assembly of claim 1, wherein a thickness of the hinge plate along the Z-axis is equal to a thickness of the cylindrical rivet head along the Z-axis.

3. The hinge assembly of claim 1, wherein the third locating hole is a through hole.

4. The hinge assembly of claim 1, wherein the cabinet plate further comprises a protrusion slot, and wherein the stiffener protrusion protrudes along the Z-axis through the protrusion slot.

5. The hinge assembly of claim 4, wherein the stiffener protrusion is a tab that extends along the Y-axis.

6. The hinge assembly of claim 1, wherein the notch partially surrounds the stiffener protrusion along the X-axis and the Y-axis.

7. The hinge assembly of claim 1, wherein the hinge plate further comprises a plurality of fastening holes defined along the Z-axis.

8. The hinge assembly of claim 1, wherein the cabinet plate is a top plate of a refrigerator appliance.

9. A method of assembling a hinge structure, the hinge structure defining an X-axis, a Y-axis, and a Z-axis and comprising a hinge plate, a cabinet plate defining a first face and a second face, a stiffener plate, and a rivet comprising a cylindrical head, the method comprising:

attaching the cabinet plate to the stiffener plate via the rivet such that the stiffener plate is in contact with the first face of the cabinet plate and the cylindrical head is in contact with the second face of the cabinet plate, wherein the cabinet plate forms at least a portion of a cabinet defining an interior volume;

inserting the cylindrical head of the rivet through a locating hole defined in the hinge plate, wherein a diameter of the cylindrical head of the rivet is predominantly equal to a diameter of the locating hole; and fastening the hinge plate to the cabinet plate and the stiffener plate via a fastener.

10. The method of claim 9, wherein a thickness of the hinge plate along the Z-axis is equal to a thickness of the cylindrical head along the Z-axis.

11. The method of claim 10, wherein the locating hole is a through hole.

12. The method of claim 9, wherein the cabinet plate further comprises a protrusion slot, and wherein the stiffener plate further comprises a stiffener protrusion protruding along the Z-axis through the protrusion slot.

13. The method of claim 12, wherein the stiffener protrusion is a tab that extends along the Y-axis.

14. The method of claim 12, wherein the hinge plate further comprises a notch for receiving the stiffener protrusion, the notch provided proximate a periphery of the hinge plate.

15. The method of claim 14, wherein the notch partially surrounds the stiffener protrusion along the X-axis and the Y-axis.

16. The method of claim 9, wherein the hinge plate further comprises a plurality of fastening holes defined along the Z-axis.

17. The method of claim 9, wherein the cabinet plate is a top plate of a refrigerator appliance.

* * * * *